US005236309A

United States Patent [19]

Van Heusden et al.

[11] Patent Number: 5,236,309

[45] Date of Patent: Aug. 17, 1993

[54] TURBINE BLADE ASSEMBLY

[75] Inventors: Gary S. Van Heusden, Oviedo; Thomas A. Brown, Winter Springs, both of Fla.; Lloyd W. Smith, Charlotte, N.C.; Ralph R. Barber, Waxhaw, N.C.; Robert M. Lloyd, Charlotte, N.C.; Phillip R. Ratliff, Weddington, N.C.; Wilmott G. Brown, Winter Park; Albert F. Le Breton, Longwood, both of Fla.; David A. Lutz, Fayetteville, N.C.

[73] Assignee: Westinghouse Electric Corp., Pittsburgh, Pa.

[21] Appl. No.: 693,256

[22] Filed: Apr. 29, 1991

[51] Int. Cl.[5] ..... B63H 1/20

[52] U.S. Cl. ..... 416/221; 416/206; 416/248

[58] Field of Search ..... 416/206, 219 R, 220 R, 416/221, 248, 500

[56] References Cited

U.S. PATENT DOCUMENTS

| | | | |
|---|---|---|---|
| 2,847,187 | 8/1958 | Murphy | 416/221 |
| 2,930,581 | 3/1960 | Klint | 416/219 R |
| 2,942,842 | 6/1960 | Hayes | 416/221 |
| 2,971,743 | 2/1961 | Welsh | 416/220 R X |
| 3,378,230 | 4/1968 | Toomey | 416/221 |
| 3,572,970 | 3/1971 | Smuland | 416/221 |
| 3,700,354 | 10/1972 | Memery | 416/219 |
| 3,904,314 | 9/1975 | Pedersen | 416/207 X |
| 4,019,832 | 4/1977 | Salemme et al. | 416/219 R X |
| 4,022,545 | 5/1977 | Shank | 416/221 |
| 4,265,595 | 5/1981 | Bucy, Jr. et al. | 416/221 X |
| 4,725,200 | 2/1988 | Welhoelter | 416/221 |
| 4,820,127 | 4/1989 | Cohen et al. | 416/206 X |

FOREIGN PATENT DOCUMENTS

| | | | |
|---|---|---|---|
| 2544952 | 5/1976 | Fed. Rep. of Germany | 416/220 R |
| 976790 | 11/1950 | France | 416/206 |
| 1491480 | 11/1977 | United Kingdom | 416/220 |

*Primary Examiner*—Edward K. Look
*Assistant Examiner*—Todd Mattingly

[57] ABSTRACT

A turbine blade assembly composed of a rotor which is rotatable about a turbine axis of rotation and a plurality of turbine blades supported by the rotor, each blade having a root and the rotor being provided with a groove shaped for holding each root in a manner such that the root and groove have mutually contacting surfaces which apply a radially inwardly directed restraining force to the root, the root further having a bottom facing the turbine axis and the groove having a base which is located radially inwardly of, and faces, the root bottom. The mutually contacting surfaces of the root and the groove are pressed together by means of at least one disc spring compressed between the root bottom and the groove base.

16 Claims, 3 Drawing Sheets

TURBINE BLADE ASSEMBLY

BACKGROUND OF THE INVENTION

1. Field of the Invention

The present invention relates to the fabrication of turbine blade assemblies and, in particular, the mounting of turbine blades in a support member.

2. Prior Art

A typical turbine blade row is composed of a plurality of individual blades which are installed in a support member, the support member typically being an annular rotor, or hub.

A conventional turbine blade includes a root via which the blade is connected to the hub and blades may be mounted on the hub in a free-standing manner, in which each blade is supported only at its root, or the blades may be further connected together near their tips. In the art, free-standing construction is currently preferred.

When blades are assembled to a hub, particularly in the case of free-standing construction, movement of each blade relative to the hub in the tangential direction of the rotor must be eliminated to the greatest extent possible at low speeds. When a turbine is rotating at high speed, centrifugal forces act to stabilize the position of each blade relative to the hub. However, at lower speeds, such as turning gear speeds, which are of the order of 3 rpm, there is a tendency for the blade roots to move circumferentially within their respective rotor grooves. Specifically, as the turbine assembly rotates points will be reached at which a blade is acted on by gravity such that the root shifts within its associated rotor groove. Such movement of the blade roots causes an effect known as "fretting", in which particles are worn from surfaces which rub together, and these particles then oxidize and harden, whereby they can seriously abrade the blade root and associated rotor groove bearing surfaces. Fretting thus reduces useful blade life in the root area due to metal fatigue.

For this reason, efforts have been made to prevent such relative movement between a blade root and its associated rotor groove at turning gear speeds.

It has previously been proposed to prevent such movements by interposing an adhesive or an expansible material in the interface between each blade root and its associated groove.

However, it has been found that adhesives which perform well from the standpoint of preventing relative movement between a blade and its associated rotor groove also leave a corrosive residue which is difficult to remove and damages the rotor groove and blade root surfaces. For these reasons, such adhesives are no longer considered acceptable.

Moreover, when it is desired to remove a blade which has been secured by means of an adhesive or expansible material, special steps must be taken, such as heating the material, to permit removal of a blade. Frequently, it is difficult to control the heating with sufficient precision, with the result that the material holding adjacent blades in place is partially degraded.

Heretofore, purely mechanical arrangements for securing a blade in place to prevent relative movement between each blade and its associated rotor have not been available.

SUMMARY OF THE INVENTION

It is an object of the present invention to simplify the fabrication of turbine blade assemblies.

Another object of the invention is to assemble turbine blades to a rotor, in a manner which is applicable to free-standing blades, and which allows convenient replacement of individual blades.

Yet another object of the invention is to support the individual turbine blades of such an assembly by a purely mechanical connection which can be made to substantially completely eliminate any play between the blade and the rotor on which it is mounted.

The above and other objects are achieved, according to the present invention, in a turbine blade assembly composed of a rotor which is rotatable about a turbine axis of rotation and a plurality of turbine blades supported by the rotor, each blade having a root and the rotor being provided with a groove shaped for holding each root in a manner such that the root and groove have mutually contacting surfaces which apply a radially inwardly directed restraining force to the root, the root further having a bottom facing the turbine axis and the groove having a base which is located radially inwardly of, and faces, the root bottom, by the improvement comprising at least one belleville washer, or disc spring, compressed between the root bottom and the groove base for pressing together the mutually contacting surfaces of the root and the groove.

Belleville washers, also identified in industrial literature as disc springs, of relatively small size can generate substantial compression forces, in the direction of their cylinder axis, while nevertheless being relatively easily displaceable transverse to that axis. Therefore, the use of such washers makes possible a secure connection between each blade root and the rotor, sufficient to at least substantially reduce the type of circumferential movement described above at low turning speeds, while allowing ready replacement of a blade when needed.

DESCRIPTION OF THE PREFERRED EMBODIMENTS

Figure 1:
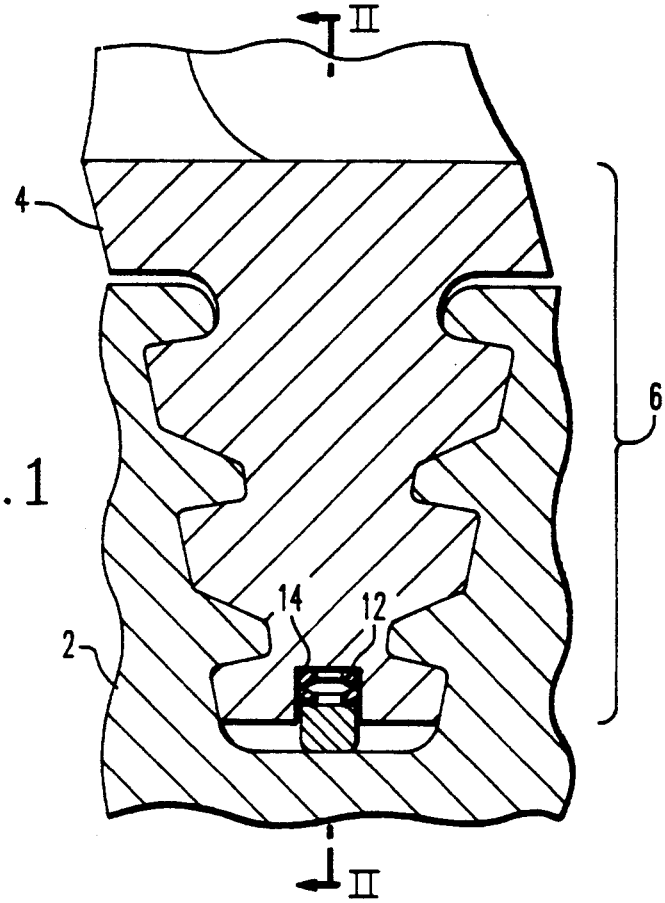
FIG. 1 is a cross-sectional view illustrating a blade assembly in which a blade root is supported with one embodiment of a blade motion restraint arrangement according to the invention.

FIG. 1 is a cross-sectional view, in a plane perpendicular to the axis of rotation of a turbine, showing a part of a turbine rotor 2 carrying a row of turbine blades 4.

Figure 2:
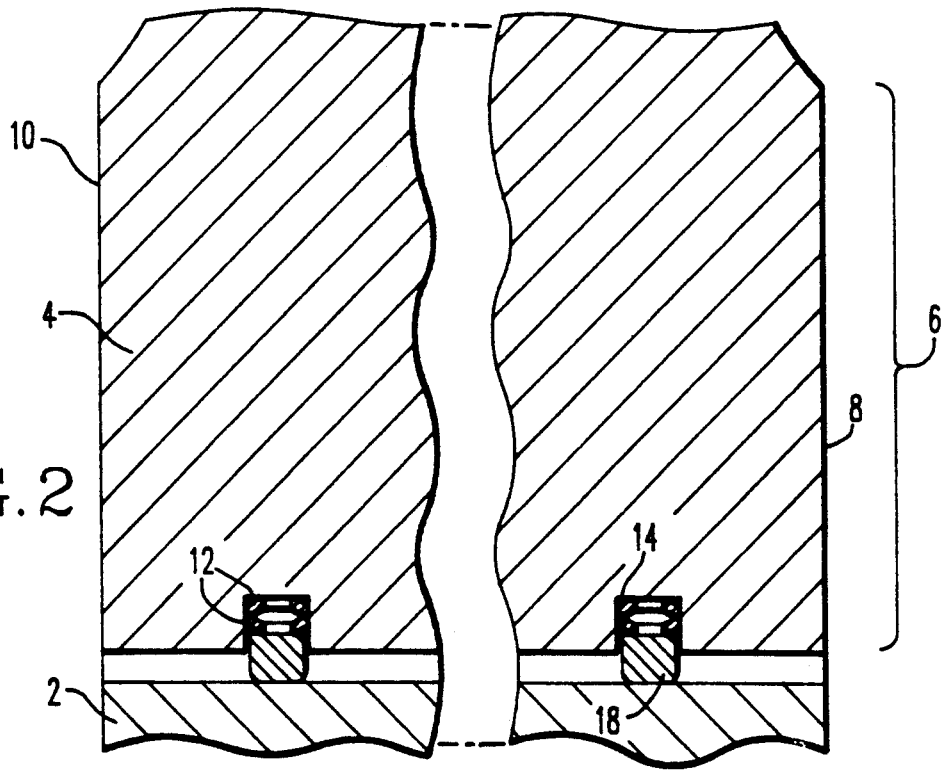
FIG. 2 is a cross-sectional view along the line II—II of FIG. 1.

FIG. 2 is a view in a plane containing the axis of rotation of the turbine.

FIGS. 1 and 2 show a part of one blade 4, and particularly the part constituting root 6 which is held in a groove in rotor 2.

To hold each blade 4 in place, root 6 and the associated groove in rotor 2 are provided with matching cross sections characterized by serrated, serpentine, or dentate edges.

The blade assembly shown in FIGS. 1 and 2 has a fluid inlet edge 8 and a fluid outlet edge 10, i.e., during operation of the turbine, steam or gas will flow from edge 8 to edge 10.

According to the invention, each blade 4 is held in place by means of belleville washers 12 retained in counterbores 14 in the base, or bottom, of root 4. The open ends of bores 14 are closed by pins 18 which are fitted to be movable in bores 14 while preventing washers 12 from falling out of bores 14 prior to installation of blade 4 in rotor 2.

Each blade 4 is inserted by driving its root 6 along an associated groove in rotor 2 parallel to the turbine axis. The end of each pin 18 which extends out of its associated bore 14 preferably has a smooth surface to facilitate this insertion movement. Insertion may be further facilitated by rounding the edge of the pin end which extends out of bore 14.

Belleville washers 12 act as springs which, when . compressed between a pin 18 and the base of a bore 14, press blade 4 radially outwardly relative to rotor 2. Belleville washers are well suited to the intended purpose because they have an extremely high load rating for their size compared to conventional springs, e.g. serpentine or coil springs.

The side wall of each bore 14 is dimensioned to hold washers 12 in place and to prevent them from collapsing. In the illustrated embodiment, two washers 12 are arranged in back-to-back, or series relation.

To replace a blade, root 6 need only be forced out of groove, e.g., by hammering, and new washers 12 can be installed in root 6 of the new blade 4 prior to installation of the new blade.

The blade securing structure described above may also be used to lock in place the last one of a row of blades while standard assembly procedures are employed for the other blades of the row, e.g. in an arrangement where the blades of a row are inserted sequentially into a circular groove.

Figure 3:
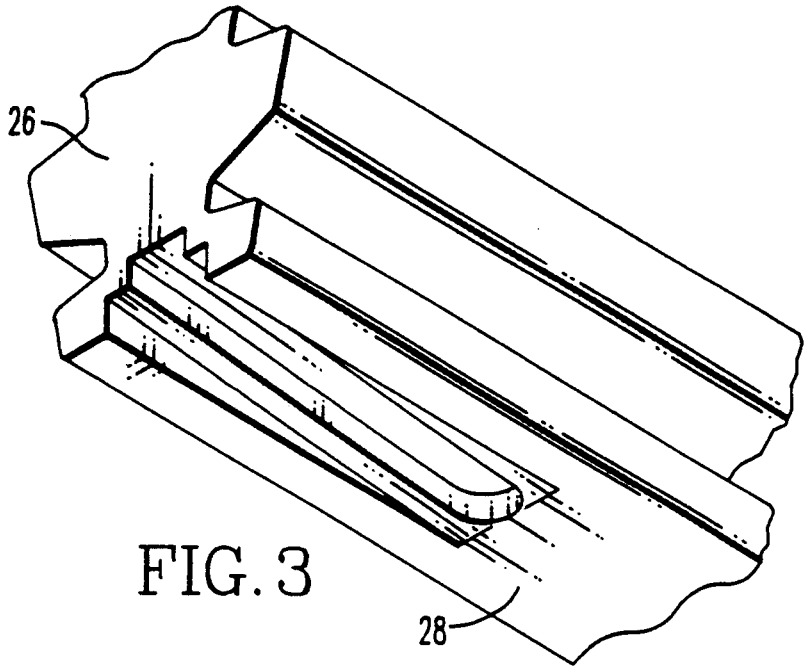
FIG. 3 is a perspective view showing one end of the bottom of a blade root formed to receive a blade motion restraint arrangement according to the invention.

One advantageous embodiment of the invention will now be described with reference to FIGS. 3 and 4. FIG. 3 shows one end of the lower part of a blade root 26 whose bottom 28 is provided with a stepped groove having a wider shallow portion and a narrower deep portion. The bottoms of the two groove portions lie in planes which are parallel to one another and slope downwardly from the associated blade assembly edge at an angle of the order of 5° relative to bottom 28. The other end of root 26 is provided with an identical groove structure.

The groove at each end of root 26 is provided to receive a group of belleville washers and a wedge for locking blade root 26 in place in an associated rotor groove.

Figure 4:
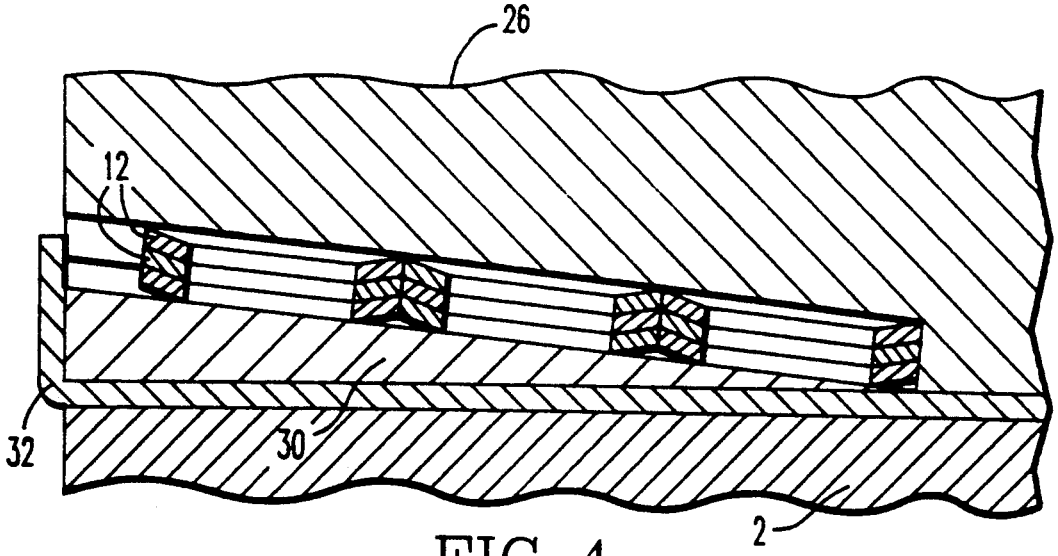
FIG. 4 is a cross-sectional detail view illustrating the root of FIG. 3 equipped with one preferred embodiment of a blade motion restraint arrangement according to the invention.

FIG. 4 is a cross sectional view in a plane passing through the center of blade root 26 and the axis of rotation of the turbine. At each end of root 26, the deep groove portion contains a plurality of belleville washers 12 and the shallow groove portion receives wedge 30.

Wedge 30 is wider at least than the inner diameter of each washer 12 and has a wedge angle of 5°.

To assemble a turbine blade in rotor 2, a shim 32 is placed in the bottom of the groove in rotor 2. Initially, shim 32 is straight and projects beyond both edges of rotor 2. Then, the turbine blade is positioned by inserting root 26 into the rotor groove.

At each end of root 26, a group of belleville washers 12 is inserted. Wedge 30 is then lubricated and driven in as far as it will go with a given driving force so that washers 12 are deformed sufficiently to produce the desired motion restraint force. Shim 32 prevents damage to the bottom of the rotor groove during this operation.

Then, any portion of wedge 30 which projects axially beyond rotor 2 is ground off and shim 32 is bent up at both ends to lock wedges 30 in place.

According to this embodiment, washers 12 are arranged in a plurality of stacks and the washers 12 in each stack are nested in one another, i.e. are disposed in parallel, to increase the force resulting from a particular degree of compression. By way of example, each end of root 26 is provided with three stacks each having three washers 12. The total number of washers and their spring constants are selected to produce the force needed to restrain each blade in place.

As shown, washers 12 project into the associated shallow groove so as to be firmly pressed by wedge 30.

When a blade must be replaced, it is only necessary to bend down the ends of shim 32 and then extract wedges 30 by means of a suitable tool.

Figure 5:
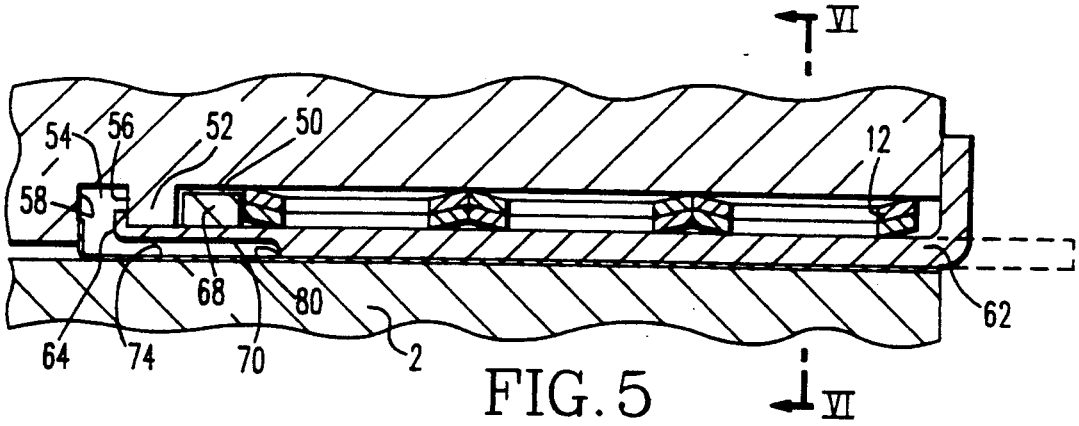
FIG. 5 is a view similar to that of FIG. 4 showing another embodiment of a blade motion restraint arrangement according to the invention.
Figure 6:
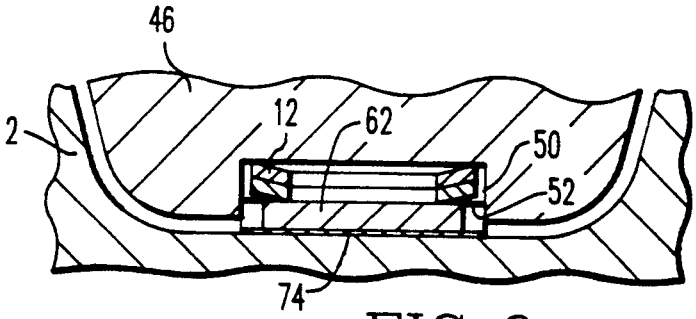
FIG. 6 is a cross-sectional view taken along line VI—VI of FIG. 5.

A particularly advantageous embodiment of the invention is depicted in FIGS. 5 and 6. In this embodiment, wedges are eliminated and the required blade motion restraint force is established essentially by proper selection of the number, size, arrangement, and spring constant of belleville washers 12. By arrangement is meant the relative orientation of washers in a stack in that, in each embodiment illustrated herein, these washers may be arranged in parallel, as shown in FIGS. 3-6, or in series, as shown in FIGS. 1 and 2, or in any desired combination of series and parallel. In general, a parallel arrangement produces a higher restoring force for a given deflection than does a series arrangement.

At each edge of blade root 46 the blade root bottom is formed with a groove 50 which extends from the associated blade edge. The end of groove 50 remote from the associated blade edge terminates at a projection, or ledge, 52. The base, or bottom surface, of ledge 52 is at a higher level, i.e. is spaced a greater distance from the rotor groove bottom, than is the blade root bottom. Behind ledge 52 there is a recess, or channel, 54 which can extend across the entire width of root 46, perpendicular to the plane of FIG. 5. Recess 54 has a front wall 56 and a rear wall 58.

Blade root 46 is held in place in rotor 2 by washers 12 and a lock strip 62 provided to lock washers 12 in place relative to root 46. Washers 12 are held in place by the side walls of groove 50, by ledge 52 and by the bent-up free end of strip 62. Depending on the number and diameter of washers 12, they may be further held in place by a filler piece 68, If the number of washer stacks, or the diameter of the washers, is reduced, a larger filler piece may be employed.

The rear, or interior, end of strip 62 is undercut to form a recess 70 so that strip 62 has a thin end portion spaced from the groove bottom by recess 70.

If desired, a shim 74 having a selected thickness is provided beneath each lock strip 62. Shim 74 will be given a thickness selected to produce the desired degree of compression of washers 12. The inner end of shim 74 is bent up so that upon being inserted into the rotor groove, the bent up end comes to bear against wall 58 to . define the installed position of shim 74.

Preferably, recess 70 is dimensioned so that the thin inner end portion of lock strip 62 has a thickness less than one-half that of the remainder of strip 62 and a length, toward the associated blade assembly edge, such that the thin inner end portion does not extend beneath the hole at the center of the washers 12 which are furthest from the associated blade assembly edge. The thinner inner end portion terminates at an edge 80 about which strip 62 is pivoted during installation.

Installation of a blade with the motion restraint arrangement of FIGS. 5 and 6 may proceed as follows.

First, blade root 46 is inserted into the groove in rotor 2 by advancing root 46 between the inlet and outlet edges of the blade assembly. The walls of root 46 and the groove on rotor 2 are shaped so that root 46 slides easily into the groove.

Then, a shim 74, if desired, is introduced into the rotor groove from each blade assembly edge.

Then, a locking strip 62 is inserted from each blade assembly edge. At this time, the outer end of each strip 62 is straight To insert strip 62, it is tilted to allow lip 64 to pass under ledge 52. Then, strip 62 is tilted back into the locked position shown in FIG. 5.

Filler 68 and stacks of washers 12 are then inserted above each strip 62. Insertion can be performed by driving, e.g. hammering, filler 68 and each washer stack in via the open end of groove 50. Washers 12 are oriented so that the inner edge of the lowermost washer 12 in each stack contacts strip 62 and the outer edge of the uppermost washer 12 in each stack contacts the bottom of groove 50.

Finally, the outer end of each strip 62 is bent up to lock washers 12 in place relative to root 46.

To remove a blade, the outer end of each strip 62 is bent down and used to pull strip 62 and washers 12 out of the groove. To achieve this, it is only necessary to pull very firmly on strip 62, for example with clamping pliers. The thin inner end of strip 62 will deflect down or break to release the connection with flange 52. Although washers 12 apply a considerable compression force to root 46, the force required to insert and extract them is substantially lower.

In tests performed with the motion restraint arrangements shown in FIGS. 3–6, it was found that the connection between each blade root 26 and rotor 2 was as rigid as that achieved when blade roots 26 are fastened in rotor grooves with the aid on an adhesive which bonds the parts together and fills the gaps between them.

Figure 7:
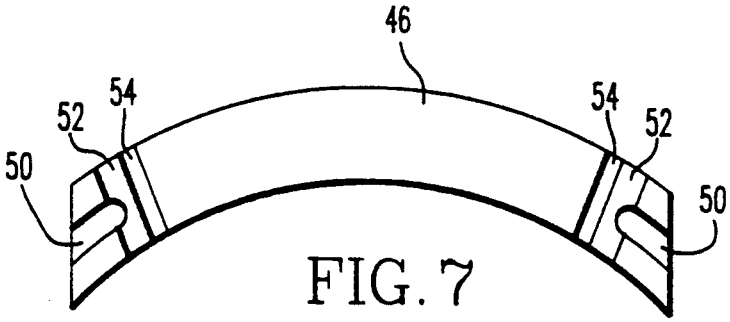
FIG. 7 is a bottom plan view showing one form of blade root to which the invention can be applied.

Motion restraint devices according to the invention can be employed with straight or curved blade roots. An example of a curved blade root 46 is shown in FIG. 7. The sides of this root follow circular arcs and each groove 50 extends generally parallel to the root sides.

All modifications which must be made to a blade root to accommodate a blade motion restraint assembly according to the invention are applied to the bottom of each root, a location where the stress in the blade root is a minimum, and installation of such an assembly will have virtually no effect on turbine assembly resonant frequencies.

In all embodiments of the invention, the bores, grooves and recesses required to accommodate belleville washers and associated parts may be formed in the groove base, rather than in the blade root bottom. However, it is generally easier to carry out the required machining operations on the blade root.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

We claim:

1. In a turbine blade assembly composed of a rotor which is rotatable about a turbine axis of rotation and a plurality of turbine blades supported by the rotor, each blade having a root and the rotor being provided with a groove shaped for holding each root in a manner such that the root and groove have mutually contacting surfaces which apply a radially inwardly directed restraining force to the root, the root further having a bottom facing the turbine axis and the groove having a base which is located radially inwardly of, and faces, the root bottom, the improvement comprising, blade motion restraint means composed of at least one disc spring having a cylinder axis, said disc spring being disposed between said root bottom and said groove base for generating a compression force in the direction of said cylinder axis between said root bottom and said groove base, so that said disc spring is compressed between said root bottom and said groove base for pressing together said mutually contacting surfaces of said root and said groove.

2. An assembly as defined in claim 1 wherein said assembly has two opposed blade assembly edges spaced apart in a direction parallel to the turbine axis, and said blade motion restraint means comprise at least two units each disposed in the vicinity of a respective edge of said assembly and each having at least one said disc spring.

3. An assembly as defined in claim 2 wherein each said unit includes at least two said disc springs disposed in a stack.

4. An assembly as defined in claim 3 wherein each said unit includes a plurality of said disc springs disposed in at least two stacks.

5. An assembly as defined in claim 3 wherein one of said root bottom and groove base is provided with a respective recess in the vicinity of each edge, and said springs of a respective unit are disposed in a respective recess.

6. An assembly as defined in claim 5 wherein each said unit comprises a retaining member for retaining said springs in said recess of said unit, each said retaining member being movable relative to its associated recess.

7. An assembly as defined in claim 2 wherein one of said root bottom and groove base is provided with a spring-receiving groove in the vicinity of each edge, each spring-receiving groove extending from its associated edge in a direction toward the other edge, and said at least one spring of each said unit is disposed in a respective spring-receiving groove.

8. An assembly as defined in claim 7 wherein each said unit further comprises a wedge compressing said at least one spring of the associated unit.

9. An assembly as defined in claim 8 wherein, in each said unit, said wedge has two wedge surfaces forming a wedge angle with one another, and said spring-receiving groove has a bottom which is inclined by the wedge angle relative to the groove base.

10. An assembly as defined in claim 9 wherein each said unit has at least two disc springs disposed in a stack such that the inner diameter of each spring faces said wedge and the outer diameter of each spring faces the bottom of said spring-receiving groove.

11. An assembly as defined in claim 8 wherein said blade motion restraint means further comprise a locking member disposed between said blade root and said rotor groove and having a portion which engages each said wedge to prevent movement of each said wedge.

12. An assembly as defined in claim 7 wherein the bottom of each said spring-receiving groove extends parallel to the groove base and each said unit further comprises a strip member dimensioned for compressing said at least one spring of the associated member against the bottom of the associated spring-receiving groove.

13. An assembly as defined in claim 12 wherein, in each said unit, said strip member engages said blade root for holding said at least one spring in place relative to said blade root.

14. An assembly as defined in claim 13 wherein each said spring-receiving groove is in said root bottom and has an inner end at a selected distance from its associated blade assembly edge, said root bottom is further provided, adjacent each said spring-receiving groove, with a wall spaced from said inner end of its associated spring-receiving groove, and said strip member of each said unit has an inner end which is bent to engage said wall adjacent the associated spring-receiving groove and an outer end which is bent to engage the associated blade assembly edge for holding said at least one spring in place.

15. An assembly as defined in claim 14 wherein each said strip member has a surface which faces said groove base and said surface has a recessed part extending from said inner end of said strip member toward the associated blade assembly edge.

16. An assembly as defined in claim 2 wherein said two units are spaced from one another in the direction parallel to the turbine axis.

* * * * *